US005483814A

United States Patent [19]

Liet

[11] Patent Number: 5,483,814

[45] Date of Patent: Jan. 16, 1996

[54] APPARATUS FOR WORKING METAL WORKPIECES

[76] Inventor: Cornelis H. Liet, Denekamperdijk 38, 7581 PJ Losser, Netherlands

[21] Appl. No.: 211,815

[22] PCT Filed: Nov. 18, 1992

[86] PCT No.: PCT/NL92/00207

§ 371 Date: Apr. 19, 1994

§ 102(e) Date: Apr. 19, 1994

[87] PCT Pub. No.: WO93/09891

PCT Pub. Date: May 27, 1993

[30] Foreign Application Priority Data

Nov. 19, 1991 [NL] Netherlands ..... 9101929
Sep. 22, 1992 [NL] Netherlands ..... 9201637

[51] Int. Cl.[6] ..... B21D 37/04

[52] U.S. Cl. ..... 72/442; 72/404; 72/446; 72/472

[58] Field of Search ..... 72/441, 442, 446, 72/404, 472; 83/552

[56] References Cited

U.S. PATENT DOCUMENTS

| | | | |
|---|---|---|---|
| 1,675,801 | 7/1928 | Gorman . | |
| 3,701,276 | 10/1972 | Malmgren | 72/404 |
| 3,830,129 | 8/1974 | Valente | 83/552 |
| 4,144,736 | 3/1979 | Honda | 72/472 |
| 4,545,233 | 10/1985 | Peddinghaus | 72/472 |
| 4,662,207 | 5/1987 | McDonald | 72/472 |

FOREIGN PATENT DOCUMENTS

| | | | |
|---|---|---|---|
| 356032 | 7/1905 | France | 83/552 |
| 507999 | 9/1920 | France | 83/552 |
| 1243492 | 9/1960 | France . | |
| 2317058 | 2/1977 | France . | |
| 2369082 | 5/1978 | France . | |
| 78271 | 3/1894 | Germany | 83/552 |
| 2648447 | 4/1978 | Germany | 72/472 |

*Primary Examiner*—David Jones
*Attorney, Agent, or Firm*—Westman, Champlin & Kelly

[57] ABSTRACT

An apparatus for working metal workpieces comprises a frame (1), a rotatable tool turret (29) movable up and down and carrying a plurality of punch tools (32) which can be moved into a working position by rotation of the tool turret. The frame (1) is provided with a corresponding stationary rotatable tool turret (33) as carrier for the die tools (34) associated with said punch tools which die tools (34) can be moved into a corresponding working position by rotation of said tool turret (33). The apparatus is made in such a manner that the centre line of the punch tool (32) located in the working position and the corresponding die tool (34) located in the working position intersects the axis of the tool turret (29) and/or the axis of the die tool turret (33).

16 Claims, 8 Drawing Sheets

APPARATUS FOR WORKING METAL WORKPIECES

The invention relates to an apparatus for working metal workpieces, comprising a frame, a rotatable tool turret movable up and down and carrying a plurality of punch tools which can be moved into a working position by rotation of the tool turret, and a die carrier carrying die tools associated with said punch tools.

A known apparatus of this type is described in GB-A-2 130 132. In this known apparatus the die tools are supported by a stationary tool support. Upon rotation of the tool turret a frame section of the apparatus moves with respect to this stationary tool support, whereby the construction of this known apparatus is complicated.

According to the invention a simple construction is obtained in that the frame is provided with a corresponding stationary rotatable tool turret as carrier for the die tools which can be moved into a corresponding working position by rotation of said tool turret.

According to a favourable embodiment of the invention each tool turret comprises a detector for detecting the rotational position of the tool turret, wherein both detectors only enable the movement of the tool turret movable up and down if corresponding punch and die tools are located in the working position. In this manner errors due to an incorrect adjustment are prevented.

As an alternative both tool turrets are coupled with each other in such a manner that upon rotation of one tool turret the other tool turret is also rotated such that in each rotational position corresponding punch and die tools are located in the working position.

If such an apparatus is provided with a main plate movable up and down, it is to be preferred according to the invention that the main plate carries the tool turret movable up and down.

The invention will be further explained by reference to the drawings in which an embodiment of the apparatus according to the invention is schematically shown.

Figure 1:
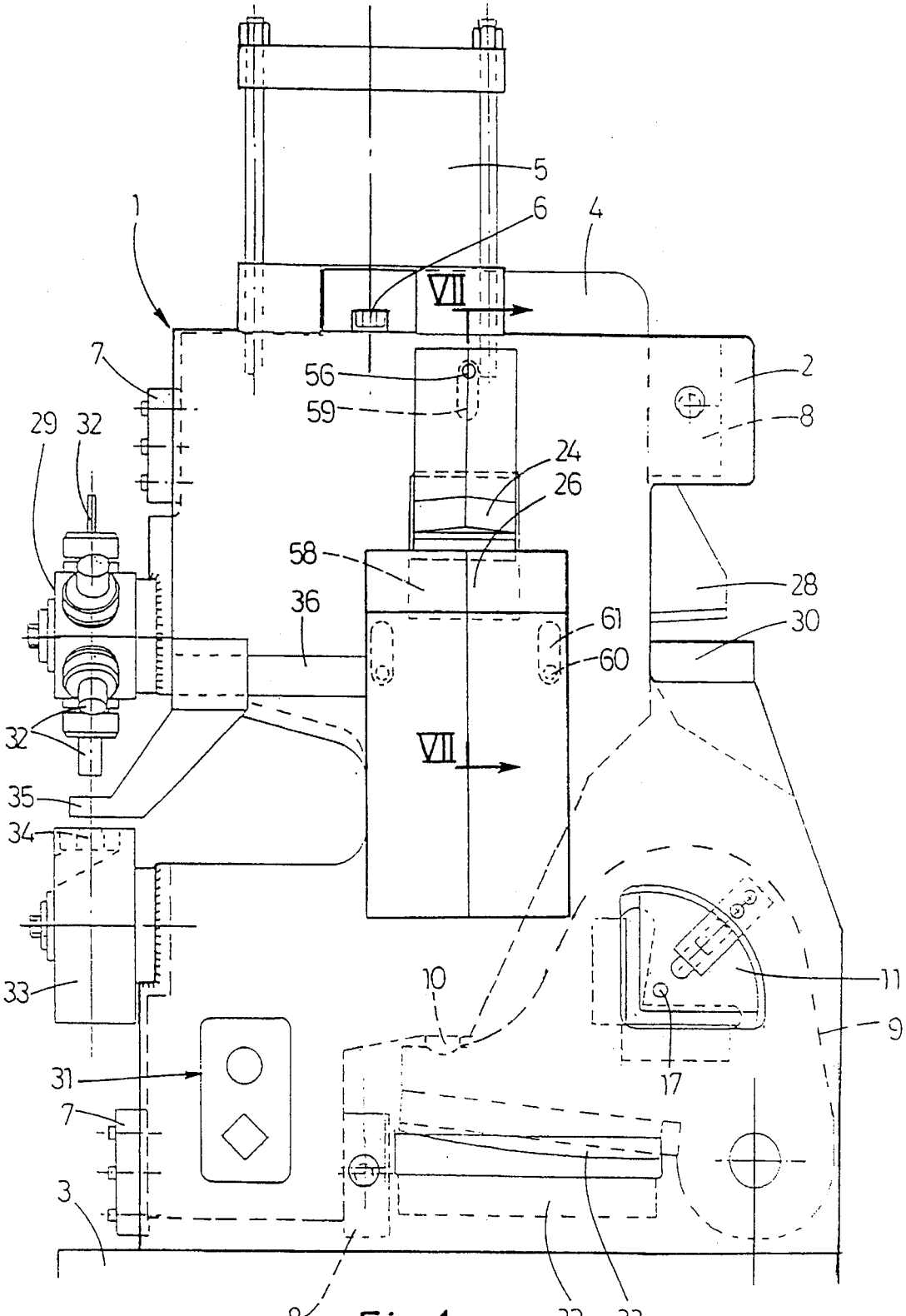
FIG. 1 is a side view of an embodiment of the apparatus according to the invention.
Figure 2:
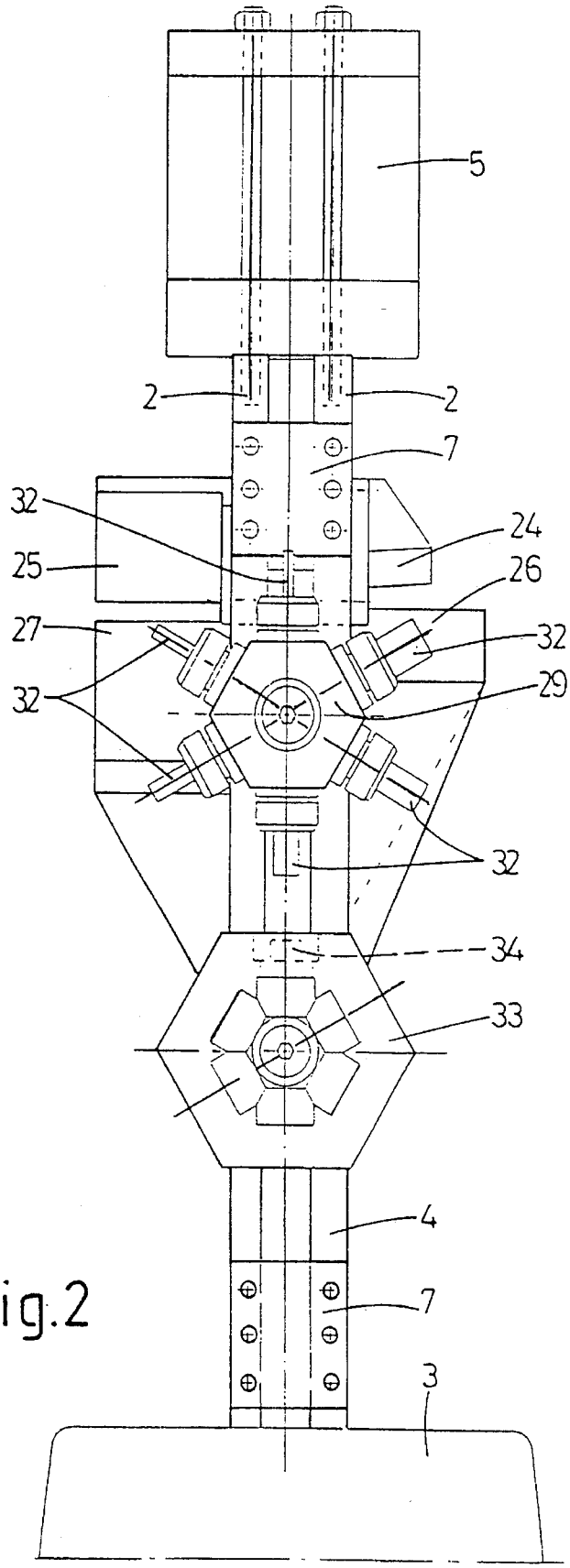
FIG. 2 is a front view of the apparatus of FIG. 1.
Figure 3:
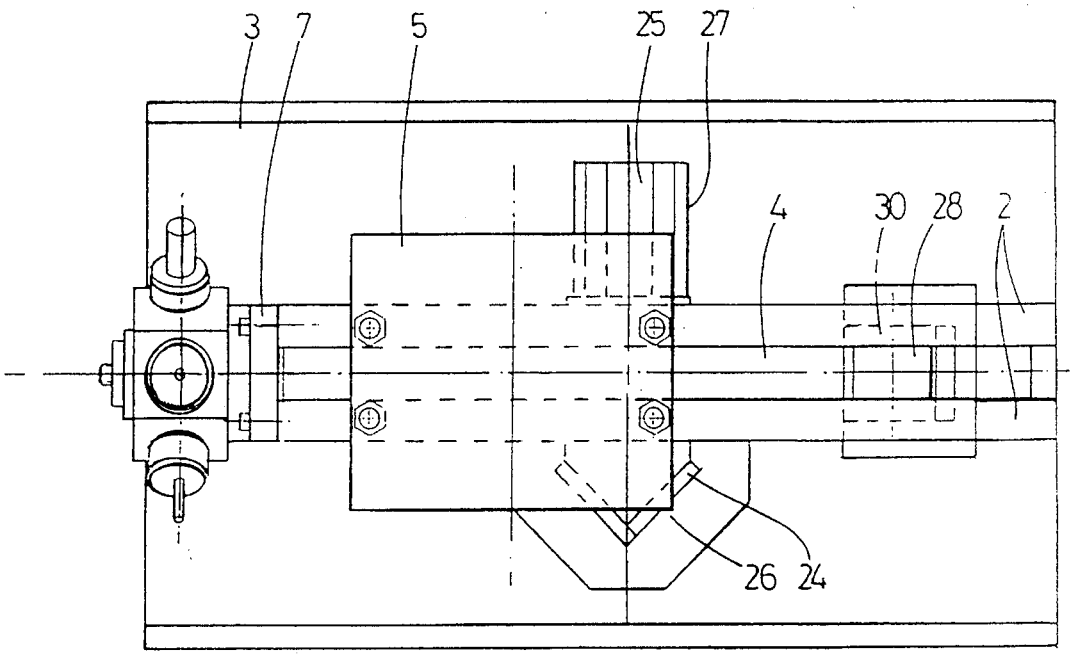
FIG. 3 is a top view of the apparatus of FIG. 1.

The apparatus shown in FIG. 1–3 for working metal workpieces comprises a frame 1 made of two web plates 2 joining a base plate 3. A main plate 4 movable up and down is guided between the web plates 2 and is driven by a hydraulic cylinder piston assembly 5 mounted at the top side of the apparatus on the web plates 2. The head of a bolt 6 can be seen in FIG. 1, by means of which the main plate 4 is connected with the piston not shown of the cylinder piston assembly 5. The main plate 4 is enclosed between fixed guiding blocks 7 at the front side of the apparatus and adjustable guiding blocks 8 at the back side and the lower centre part of the apparatus, respectively. Suitable sliding elements can be provided between the guiding blocks 7, 8 and the main plate 4.

The apparatus further comprises a carrier plate 9 pivotably borne in the frame 1 and connected to the main plate 4 by a bearing 10. The carrier plate 9 is therefore also driven through the main plate 4 by the cylinder piston assembly 5.

Figure 4:
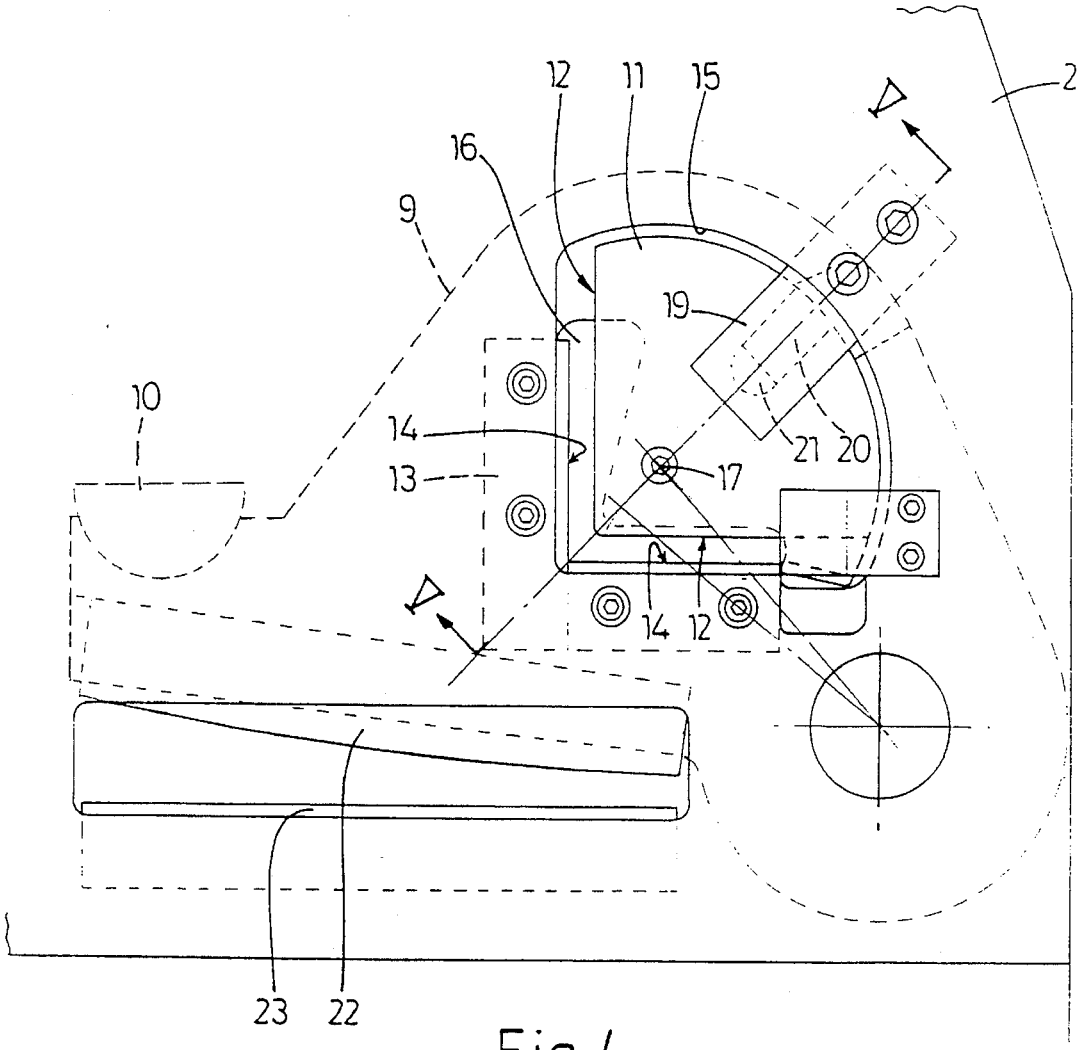
FIG. 4 shows in a larger scale a detail of the apparatus of FIG. 1.
Figure 5:
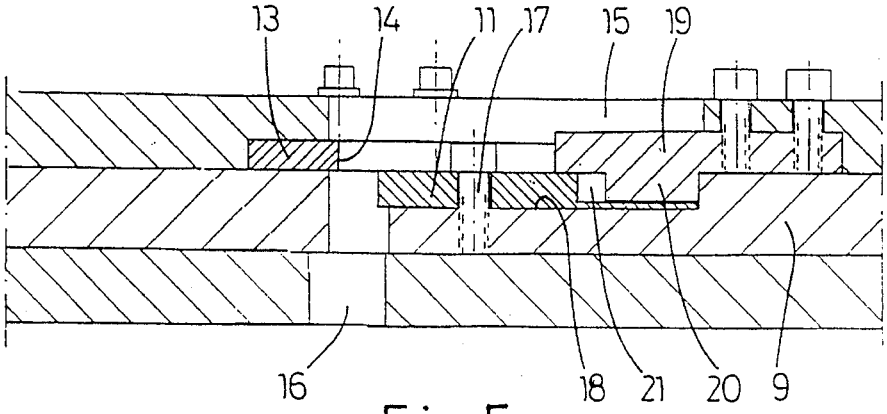
FIG. 5 is a section according to the line V—V of FIG. 4.

As shown in detail in FIG. 4 and 5, the carrier plate 9 comprises a substantially triangular shear blade 11, the straight triangle sides of which enclose a right angle and form the cutting edges 12 of the shear blade 11 extending substantially horizontally and vertically, respectively. The frame 1 supports a stationary shear blade 13 with corresponding cutting edges 14. A suitable opening 15 is provided in the web plate 2 shown in FIG. 1 for reaching and, if necessary, changing the shear blade 11, while a substantially L-shaped opening 16 is provided in the other web plate 2, so that angle workpieces and the like can be cut.

The shear blade 11 further comprises an arcuate triangle side and is mounted in a recess of the carrier plate 9 complementary to the shear blade 11, by means of a bolt 17. The bolt 17 determines a shear blade axis lying at a distance from the angle as determined by the cutting edges 12, namely at the bisector of this right angle. In order to guarantee a movement of the shear blade 11 according to this bisector towards the counter shear blade 13 during pivoting of the carrier plate 9, a guiding element 19 is fixed to the frame 1, said guiding element carrying an elongated cam 20. This cam 20 engages a slot 21 of the shear blade 11, said slot extending according to the bisector of the right angle between the cutting edges 12. It is also possible to provide the shear blade 11 with the cam 20 and to provide the slot 21 in the guiding element 19.

The location of the shear blade axis 17 at a distance of the right angle results in the advantage that the cutting forces occurring during operation at both sides of the shear blade axis 17 partially counter balance each other so that these cutting forces are taken by the engagement of the arcuate triangle side and the arcuate edge of the recess 18 in the carrier plate 9. Thereby the cam 20 is not heavily loaded. Because the main plate 4 engages the carrier plate 9 at the bearing 10, a higher cutting force is available at the location of the shear blade 11 than the force provided by the cylinder piston assembly 5.

As shown in FIG. 1 and 4, the carrier plate 9 further carries a shear blade 22 and the frame at this location carries a counter shear blade 23 for cutting flat workpieces.

FIG. 1–3 further show that the main plate 4 is provided with a protruding tool 24, 25 on both main surfaces. The tool 24 is made as a triangular punch cooperating with a die 26 supported by a corresponding web plate 2 of the frame 1. The tool 25 is made as a forming unit cooperating with a die 27 supported by the corresponding web plate 2 of the frame 1. Further, both vertical end faces of the main plate 4 also each carry a tool 28, 29, respectively. The tool at the back side is made as a rectangular punch cooperating with a die 30 supported by the frame 1. The tool 29 is made as a rotatable tool turret and will be further explained hereinafter.

It will be clear that by providing the main plate 4 with said different tools a very versatile apparatus for working metal workpieces is obtained. It is noted that the different tools 24, 25, 28, 29 as mentioned are only mentioned by way of example only and that other types of tools are also possible.

The web plates 2 of the frame 1 are coupled with each other in a non-slidable manner above and below the main plate 4. To this end one of the web plates 2 is provided with projecting key parts at its upper and lower sides in a manner not further shown, said key parts fittingly engaging slots provided at the upper and lower sides of the other web plate. Thereby, it is obtained that the web plates 2 and the main plate 4 may take very high loads.

In the side view of FIG. 1 it is further indicated that the frame 1 and the main plate 4 are also provided with cutting tools 31 for cutting round and square workpieces.

The tool 29 is made as a rotatable tool turret carrying six different punch tools 32. By rotating the tool turret 29 these punch tools 32 may subsequently be located in a vertically downwardly directed working position. A tool turret 33 which is also rotatable, is mounted on the frame 1 in a fixed position and carries die tools 34 corresponding with the different punch tools 32, which die tools may be located in an upwardly directed working position by rotation of the tool turret. As indicated in FIG. 1, the frame 1 further carries a detainer which, during the upward movement of the tool turret 29, prevents the workpiece to follow the punch tool 32. The detainer 35 is slidable on a guide 36.

Figure 6:
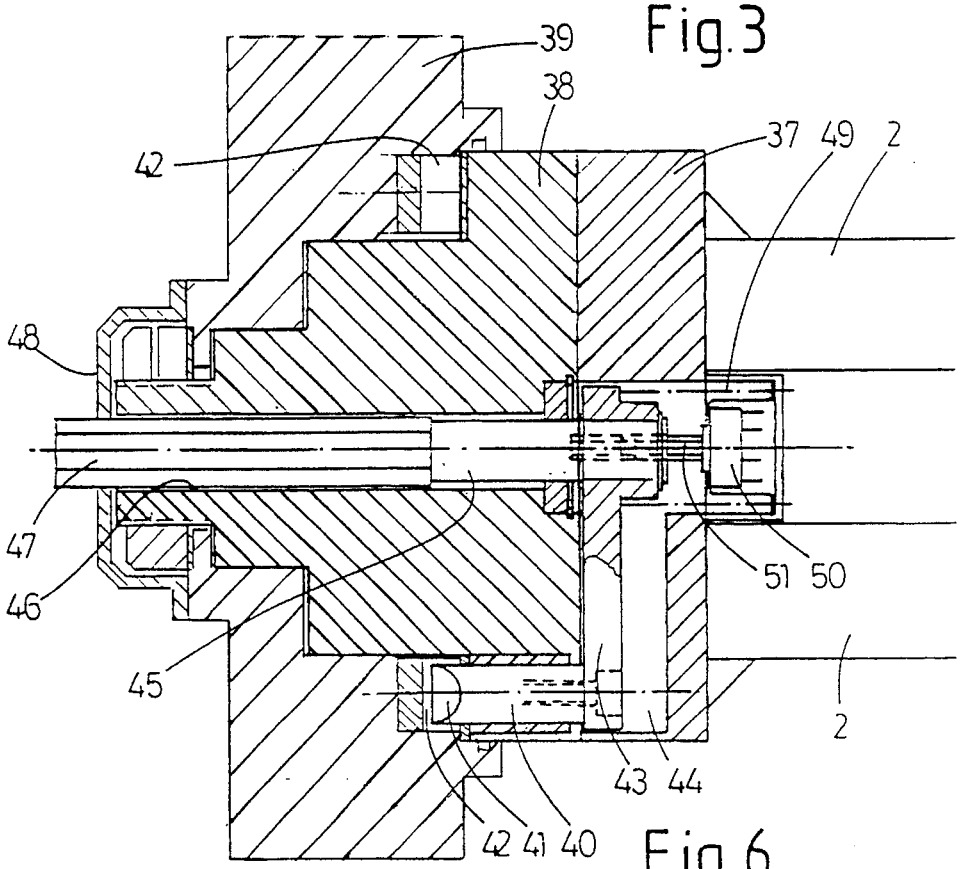
FIG. 6 is a section of the stationary tool turret of the apparatus of FIG. 1.

FIG. 6 shows a horizontal section of the fixed or stationary tool turret 33; the construction of the tool turret 29 fully corresponds with the same of the tool turret 33 wherein of course instead of die tools 34 punch tools 32 are provided. The construction of the tool turret 29 will not be described separately.

The tool turret 33 comprises a carrier plate 37 attached to the web plates 2 and a round support 38 attached to this carrier plate 37, said support being stepped in section. A drum 39 is rotatably mounted on this round support 38, said drum 39 carrying the die tools 34 or punch tools 32. The drum 39 is locked in the desired position by a locking pin 40 adapted to engage with a bevelled head 41 which is V-shaped in section, in openings 42 of the drum 39 having a V-shape in section. For each die or punch tool a corresponding V-shaped opening 42 is provided. Due to the bevelled shape of the head 41 of the locking pin 40 and the cooperation with V-shaped openings 42 of the drum 39 an excellent stable locking of the tool turret 33 in the desired position is obtained by the wedge operation of the corresponding oblique faces. Moreover, the locking pin 40 can easily be pushed out of an opening 42 because the locking pin 40 cannot get jammed.

The locking pin 40 is carried by an arm 43 received in a chamber 44 formed in the carrier plate 37. A shaft 45 is rotatably received in an axial cavity 46 in the support 38 and also extends rotatably the arm 43. A hexagonal part 47 projects through a complementary opening in a closing cap 48 of the drum 39. Although the shaft 45 can rotate with respect to the arm 43, the arm 43 cannot move in axial direction with respect to the shaft 45.

If the shaft 45 is pushed inwardly, the locking pin 40 is disengaged from the opening 42 so that subsequently a desired die or punch tool 34, 32 can be moved into the working position. By a schematically shown spring 49 the arm 43 with the shaft 45 is moved back into the locking position.

In order to prevent an incorrect positioning of a punch tool 32 and a die tool 34 in the working position, each tool turret 29, 33 is provided with a detector 50 for detecting the rotational position of the corresponding tool turret 29, 33. In the embodiment shown this detector 50 comprises a switch with six positions, the shaft 51 of which is coupled with the shaft 45 in a non-rotatable manner. Both detectors 50 are connected with the usual operating means of an apparatus of this type in such a manner that the cylinder piston assembly 5 can only drive the main plate 4 if corresponding punch and die tools are in the working position. As an alternative it is also possible to couple the tool turrets 29, 33 in such a manner with each other that upon rotation of one tool turret for moving a tool 32, 34 into the working position, the other tool turret is automatically rotated to move the corresponding tool 34, 32 into the working position. This coupling can for example be a mechanical coupling through tooth belts and wheels and the like.

As appears from FIG. 2 and 3, the tools 24, 25 are aligned opposite each other wherein the mounting of these tools to the main plate 4 is provided by means of common mounting openings in the main plate 4. Thereby it is obtained that for two tools weakened locations in the main plate 4 are required at one location only.

Figure 7:
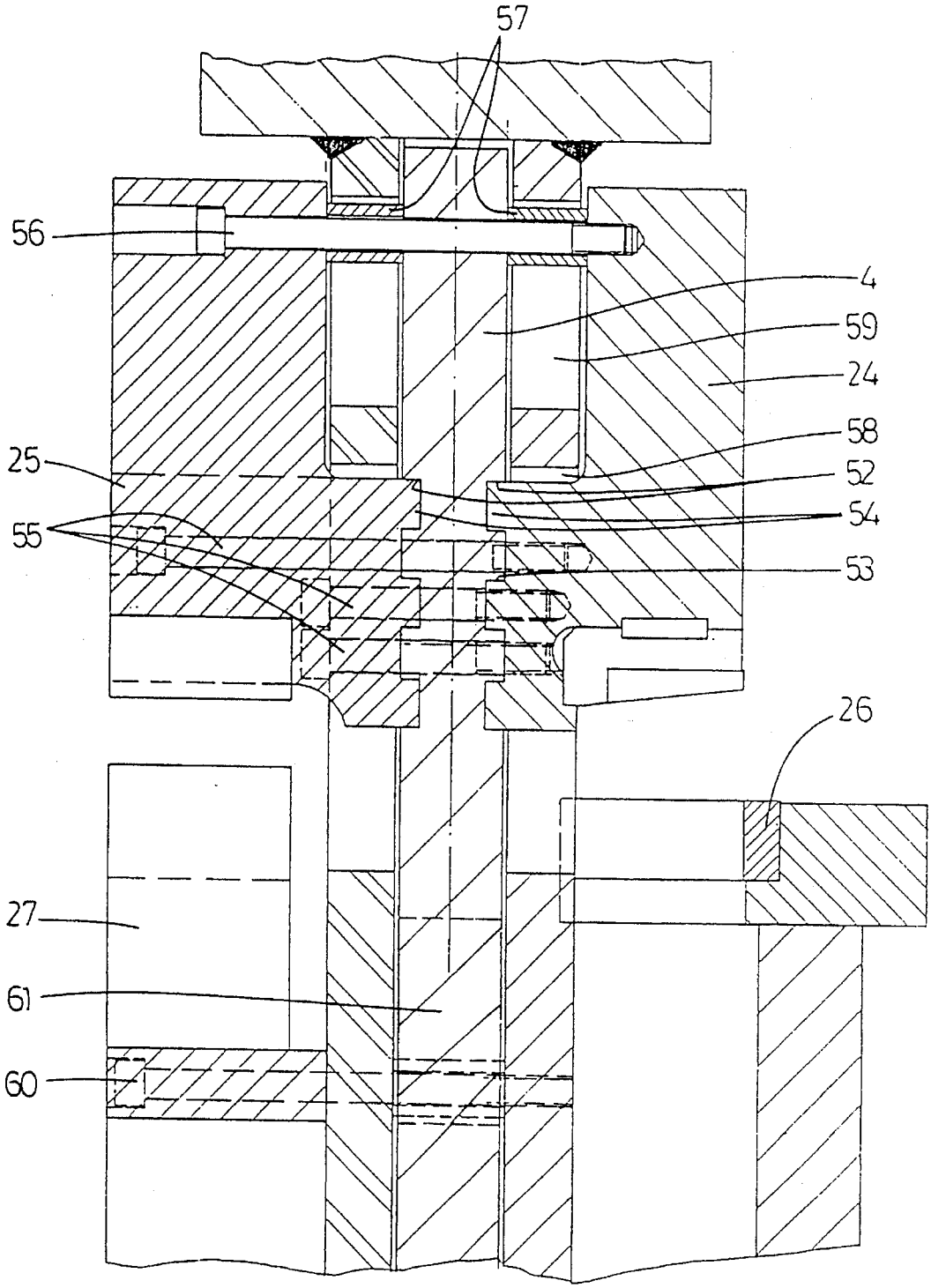
FIG. 7 is a section according to the line VII—VII in FIG. 1.
Figure 9:
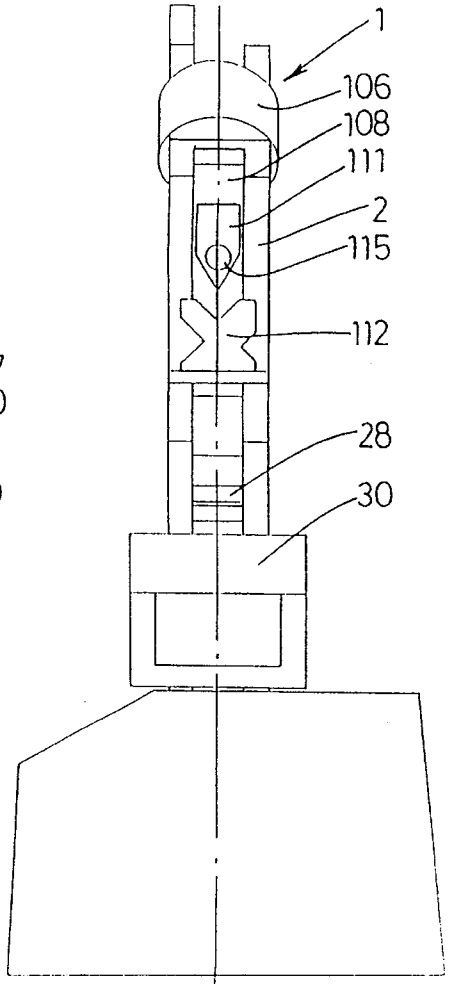
FIG. 9 is a back view of the apparatus of FIG. 8.

FIG. 7 shows a cross section of the apparatus described at the location of the tools 24, 25, wherein the mounting of these tools to the main plate 4 is shown in more detail. Slots 52 are provided in the main plate 4 whereas slots 53 are provided at the side of the tools 24, 25 directed to the main plate 4, whereby projecting parts 54 are obtained. These parts 54 fittingly engage as keys in the slots 52 of the main plate 4 so that shearing forces occurring during operation are taken by this slot and key connection 52, 54.

The tools 24, 25 are fixed to the main plate 4 by means of a plurality of draw bolts 55 at the location of the key and slot connection 52, 54. At the upper side the tools 24, 25 are fixed by one (or more) draw bolt(s) 56, wherein spacers 57 are provided between the tools 24, 25 and the main plate 4. Of course suitable openings 58 and slots 59 are formed in the web plates 2 to provide the required freedom of movement. In the embodiment shown the supports for the dies 26, 27 are fixed to the web plates 2 by draw bolts 60. Between the die supports 26, 27 and the web plates a key and slot connection or the like can also be provided for taking the shearing forces. Slots 61 are provided in the main plate 4 to receive the draw bolts 60.

It is noted that the part of the apparatus with the carrier plate 9 and the shear blade 11 can also be used separately from the other parts of this apparatus. It is also possible to equip the apparatus with the tools 24, 25, 28, 29 without the use of the pivotable carrier plate 9. Further, it is possible to equip an apparatus with the tool turrets 29, 33 only, wherein the tool turret 29 is directly driven by a cylinder piston assembly.

Figure 8:
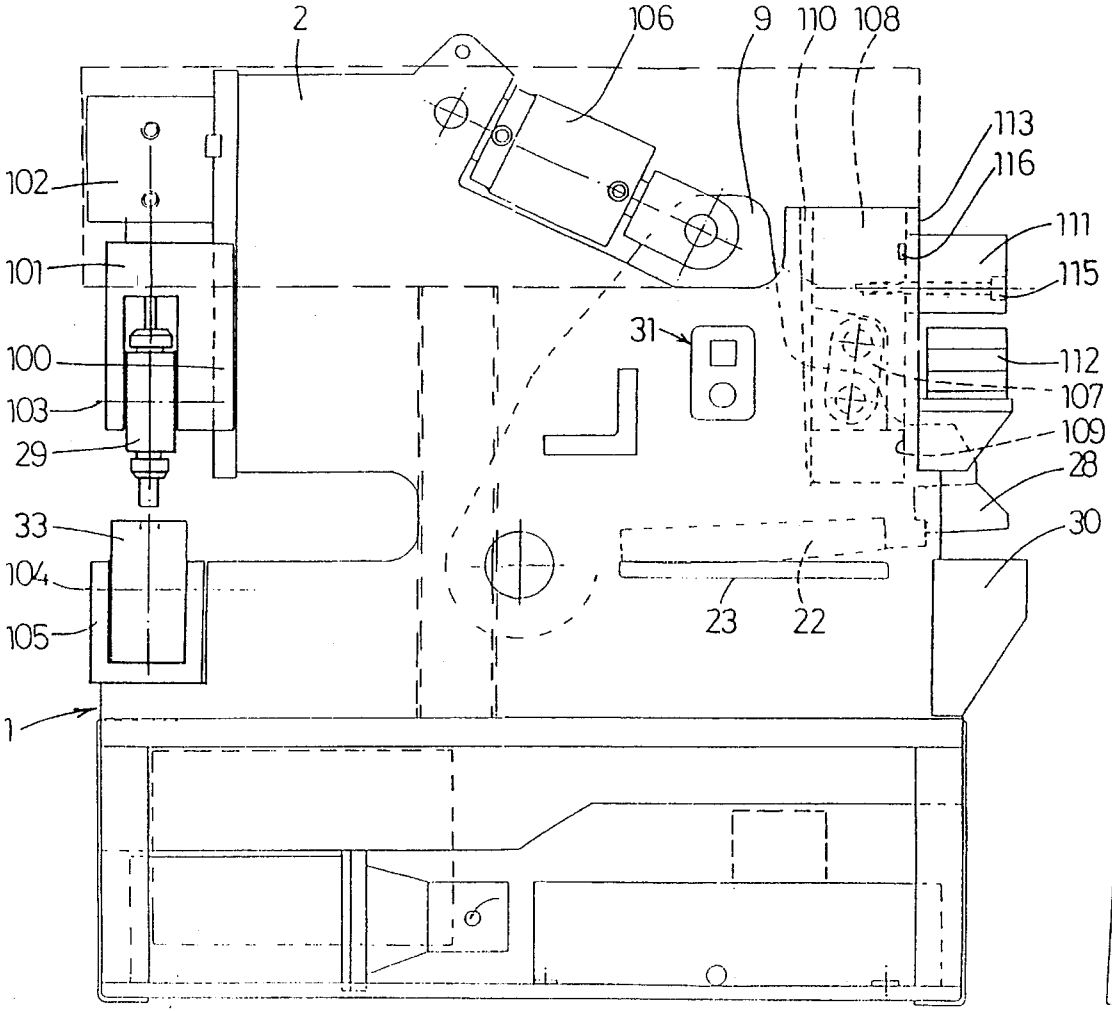
FIG. 8 is a side view of a second embodiment of the apparatus according to the invention.

An apparatus made in this manner is schematically shown in a side view in FIG. 8. In this case the web plates 2 at the front side of the apparatus carry a guide track 100, a slide 101 being movable up and down along said track. The slide 101 is driven by a hydraulic cylinder piston assembly 102. The centre line of the cylinder piston assembly 102 coincides with the centre line of the punch tool 32 lying in the working position, whereby a very favourable force transmission is obtained. The slide 101 is U-shaped and carries the tool turret 29 which is borne at both sides in the U-shaped slide 101 by a schematically indicated shaft 103. The tool turret 33 is also borne at both sides in a U-shaped holder 105 by a schematically indicated shaft 104. The holder 105 is stationary supported on the frame 1. By supporting the tool turrets 29, 33 in the U-shaped slide 101 and the U-shaped holder 105, respectively, relatively, relatively high forces can be taken.

In the embodiment of FIG. 8 the pivotable carrier plate 9 can be driven by a hydraulic cylinder piston assembly 106 which is located in an oblique position substantially right above the pivot point of the carrier plate 9. The connection point between the cylinder piston assembly 106 and the carrier plate 9 lies between two boundary planes which are determined respectively by the centre lines of the pivot point of the carrier plate 9 and the hinge point connecting the cylinder piston assembly with the frame and the vertical end face 113 of the frame. Thereby a compact construction is obtained. Further, the carrier plate 9 is equipped with a triangular shear blade not shown in the manner described. The carrier plate 9 also includes the cutting tools 31. In this case the carrier plate 9 is also provided with a tool 28 cooperating with a die 30 supported by the frame 1. Finally, the carrier plate 9 is equipped with the shear blade 22 whereas the frame at this location supports a counter shear blade 23 for cutting flat workpieces.

As indicated by a dashed line in FIG. 8 the carrier plate 9 is connected by a link 107 with a slide 108 which is guided movably up and down in the frame 1. To this end each web plate 2 is provided with a slot 109 as shown in a top view according to FIG. 11. The clearance for the movement of the slide 108 in the slots 109 is adjustable by means of an adjustment wedge 110.

The slide 108 carriers a bending tool 111 cooperating with a die 112 supported by the frame 1 and having different V-shaped recesses. The web plates 2 at the location of the slide 109 have a flat mainly vertical end edge 113 so that the bending tool 111 and the die 112 are completely freely accessible. Thereby the material to be bent does not meet any obstructions during bending and the most fantastic shapes can be bent.

Figure 11:
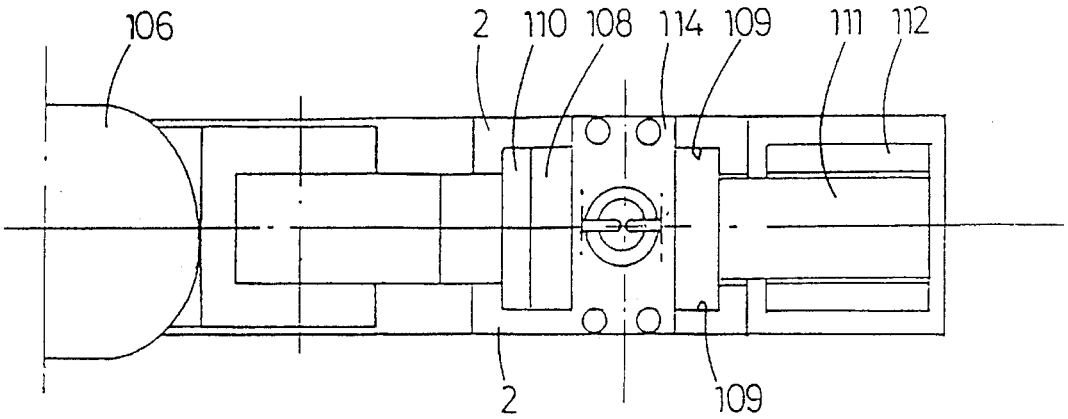
FIG. 11 is a partially shown top view of the apparatus of FIG. 10.
Figure 10:
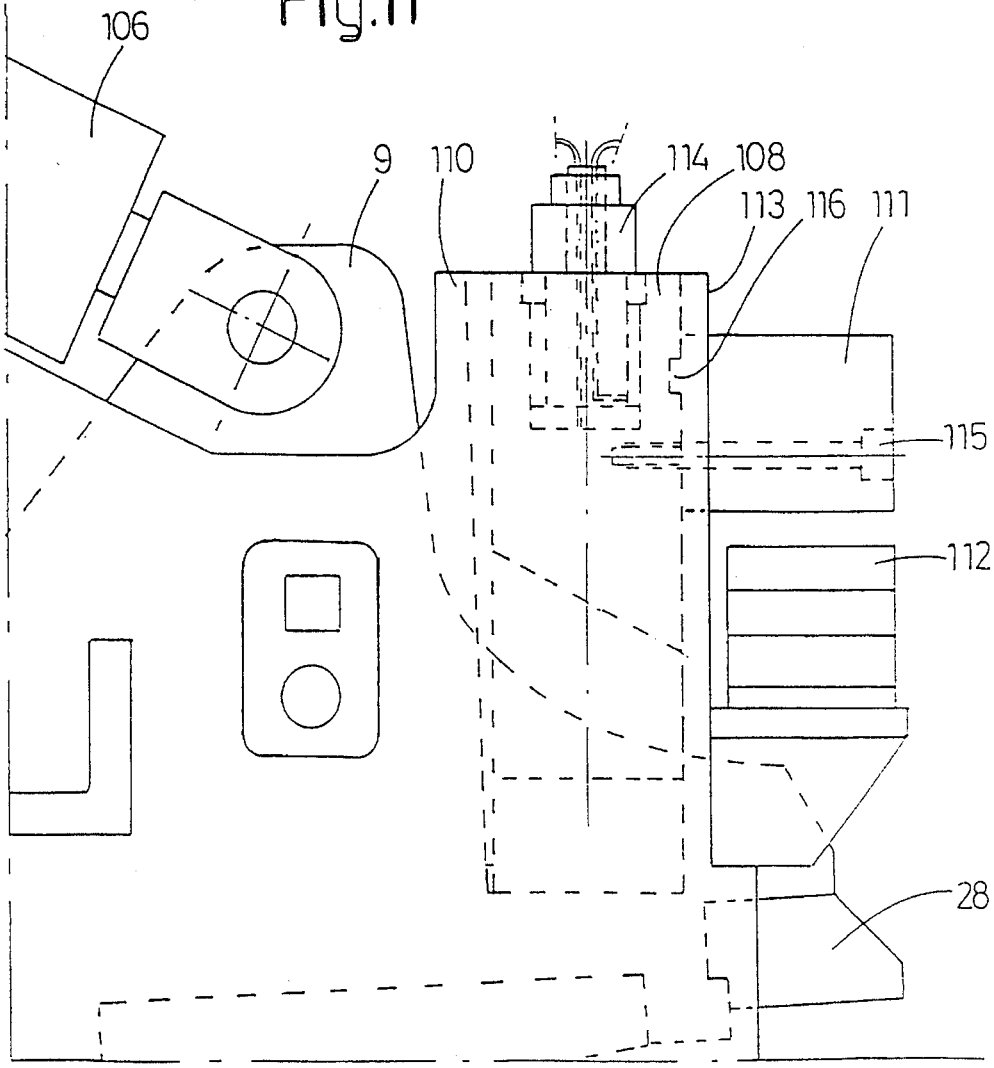
FIG. 10 is a side view partially shown of a third embodiment of the apparatus according to the invention.

FIG. 10 partially shows a side view of another embodiment of the apparatus according to the invention mainly corresponding with the embodiment of FIG. 8. In this case, however, the slide 108 is not coupled by a link with the pivotable carrier plate 9. The slide 108 is driven by a hydraulic cylinder piston assembly 114. This embodiment further fully corresponds with the embodiment of FIG. 8. FIG. 11 shows a top view of the apparatus of FIG. 10, wherein the slide 108, the slots 109 and the adjustment wedge 110 can be seen.

It is noted that the bending tool 111 is fixed to the slide 108 by means of a bolt 115 and a key 116.

Figure 12:
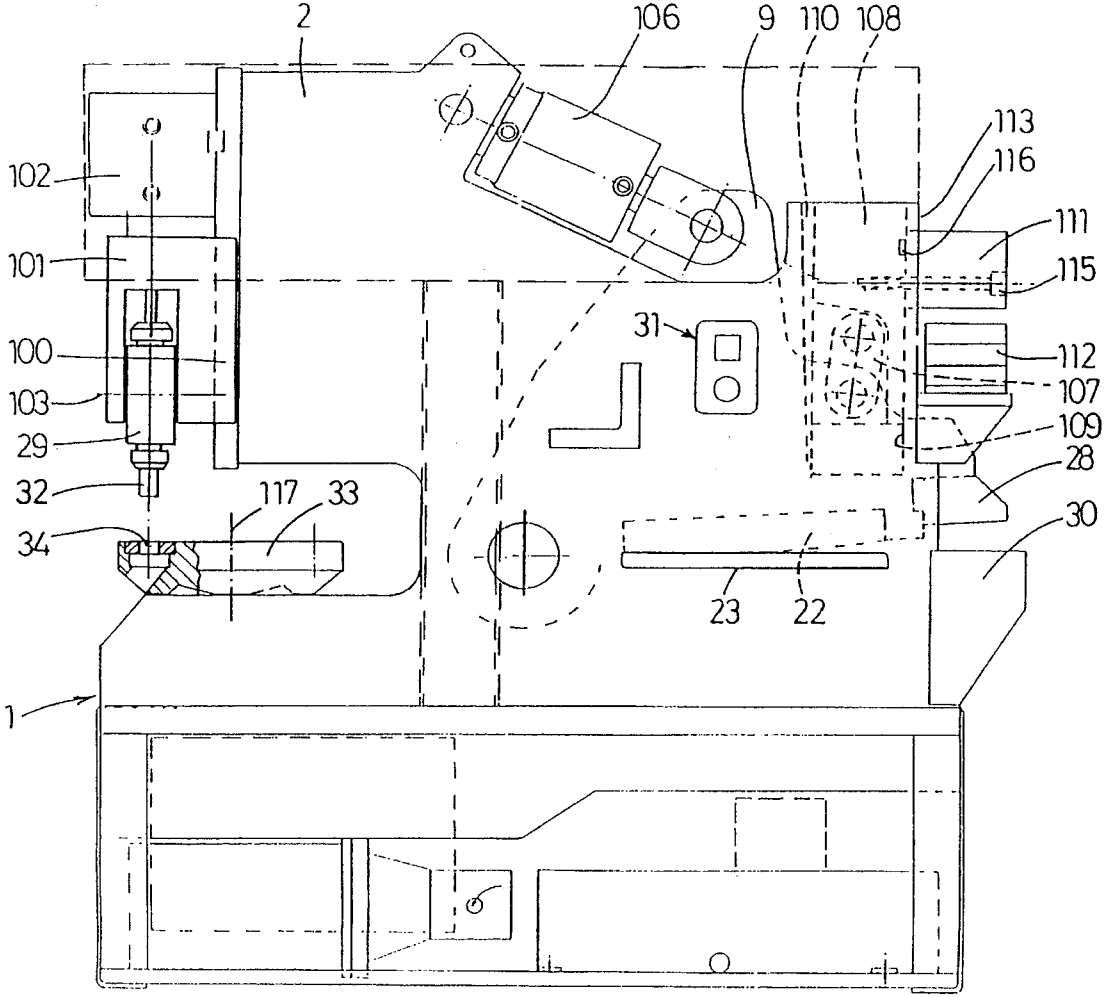
FIG. 12 is a side view of a fourth embodiment of the apparatus according to the invention.

FIG. 12 shows a side view of an apparatus mainly corresponding with the embodiment of FIG. 8. However, in this case the die tool turret 33 is supported on the frame 1 rotatably around a vertical axis 117. Just as in the other embodiments wherein both tool turrets 29, 33 are rotatable around a horizontal axis, both tools 33, 34 located in a working position are located on a centre line intersecting the horizontal axis of the tool turret 29.

The invention is not restricted to the above described embodiments which can be varied in a number of ways within the scope of the invention.

I claim:

1. An apparatus for working metal workpieces, comprising a frame, a die tool turret joined to the frame on only one end thereof for rotation about a fixed die tool turret axis, wherein the die tool turret carries die tools which can be moved into a corresponding working position by rotation of said die tool turret about the die tool turret axis, a punch tool turret joined to the frame on only one end thereof for movement toward and away from the die tool turret and rotation about a horizontal axis, the punch tool turret carrying a plurality of punch tools associated with said die tools which can be moved into a working position by rotation of the punch tool turret about the horizontal axis, wherein the die tool turret is coupled to the punch tool turret such that rotation of one tool turret rotates the other tool turret to align corresponding punch and die tools in the working positions.

2. The apparatus according to claim 1, wherein a centre line of the punch tool located in the working position and the corresponding die tool located in the working position intersects at least one of the horizontal axis of the punch tool turret and the die tool turret axis.

3. The apparatus according to claim 2, wherein the die tool turret axis is horizontal and the punch tool turret and the die tool turret are located a same side of the frame.

4. The apparatus according to claim 1, wherein each tool turret comprises a detector for detecting a rotational position of the corresponding tool turret, and wherein both detectors only enable the movement of the punch tool turret toward and away from the die tool turret if corresponding punch and die tools are located in the working position.

5. The apparatus according to claim 1, wherein each tool turret is provided with a locking opening for each punch and die tool and a non-rotatable locking pin adapted to cooperate with each locking opening to lock the tool turret in a desired working position, each locking opening being covered by a cover member when the locking pin is not inserted therein.

6. The apparatus according to claim 5, wherein the locking pin comprises a bevelled head with a V-shaped section and each locking opening has a corresponding V-shaped section.

7. The apparatus according to claim 5, wherein the locking openings of the die tool turret open to a side of the die tool turret facing the frame.

8. The apparatus according to claim 1, and further comprising a U-shaped support mounted to the frame having extending spaced-apart legs, wherein the die tool turret is rotatably mounted to the U-shaped support between the spaced-apart legs.

9. The apparatus according to claim 1, and further comprising an actuator mounted to the frame for moving the punch tool turret toward and away from the die tool turret along a centre line, the centre line being aligned with a centre line of a punch tool in the working position.

10. The apparatus according to claim 1, wherein the frame includes a guide track, and the apparatus further comprises a U-shaped slide having a leg adapted to slide upon the guide track, the punch tool turret being mounted to the U-shaped slide.

11. The apparatus according to claim 1, wherein the die tool turret is provided with a discharge channel for each die in the die tool turret, each discharge channel having a first aperture adjacent each corresponding die and a second aperture opening to a side of the die tool turret directed away from the frame, wherein each second aperture is greater than each corresponding first aperture.

12. The apparatus for working metal workpieces, comprising a frame, a die tool turret joined to the frame on only one end thereof for rotation about a fixed axis, wherein the die tool turret carries die tools which can be moved into a corresponding working position by rotation of said die tool turret about the fixed axis, a punch tool turret joined to the frame on only one end thereof for movement toward and away from the die tool turret and rotation about a horizontal axis, the punch tool turret carrying a plurality of punch tools associated with the die tools which can be moved into a working position by rotation of the punch tool turret about the horizontal axis, wherein each tool turret is provided with a locking opening for each punch and die tool and a non-rotatable locking pin adapted to cooperate with each locking opening to lock the tool turret in a desired working position, each locking opening being covered by a cover member when the locking pin is not inserted therein.

13. The apparatus according to claim 12, wherein the die tool turret is coupled to the punch tool turret such that rotation of one tool turret rotates the other tool turret to align corresponding punch and die tools in the working position.

14. The apparatus according to claim 12, wherein the locking openings of the die tool turret open to a side of the die tool turret facing the frame.

15. The apparatus according to claim 12, wherein the locking pin comprises a bevelled head with a V-shaped section and each locking opening has a corresponding V-shaped section.

16. An apparatus for working metal workpieces, comprising a frame having a guide track, a die tool turret joined to the frame on only one end thereof for rotation about a fixed axis, wherein the die tool turret carries die tool which can be moved into a corresponding working position by rotation of said die tool turret about the fixed axis, a U-shaped slide movable relative to the frame having a pair of spaced-apart legs with one leg adapted to slide upon the guide track toward and away from the die tool turret, a punch tool turret supported by the legs of the U-shaped slide for rotation about a horizontal axis, the punch tool turret carrying a plurality of punch tools associated with said die tools which can be moved into a working position by rotation of the punch tool turret about the horizontal axis.

* * * * *

UNITED STATES PATENT AND TRADEMARK OFFICE

CERTIFICATE OF CORRECTION

PATENT NO. : 5,483,814

DATED : January 16, 1996

INVENTOR(S) : Cornelis H. Liet

It is certified that error appears in the above-indentified patent and that said Letters Patent is hereby corrected as shown below:

Column 7, line line 11, replace "tool", second occurence, with --tools--.

Signed and Sealed this

Twenty-third Day of July, 1996

*Attest:*

*Attesting Officer*

BRUCE LEHMAN

*Commissioner of Patents and Trademarks*